US009562533B2

(12) United States Patent
Johchi et al.

(10) Patent No.: US 9,562,533 B2
(45) Date of Patent: Feb. 7, 2017

(54) CRYOGENIC PUMP FOR LIQUEFIED GASES

(75) Inventors: Taketo Johchi, Izumiotsu (JP); Shingo Kunitani, Sennan-gun (JP); Akira Yoshino, Osaka (JP)

(73) Assignee: Air Water Inc. (JP)

( * ) Notice: Subject to any disclaimer, the term of this patent is extended or adjusted under 35 U.S.C. 154(b) by 287 days.

(21) Appl. No.: 13/882,259

(22) PCT Filed: Sep. 14, 2011

(86) PCT No.: PCT/JP2011/071545
§ 371 (c)(1),
(2), (4) Date: May 13, 2013

(87) PCT Pub. No.: WO2013/056832
PCT Pub. Date: May 3, 2012

(65) Prior Publication Data

US 2013/0216405 A1 Aug. 22, 2013

(30) Foreign Application Priority Data

Oct. 29, 2010 (JP) ..... 2010-242924

(51) Int. Cl.
*F04D 7/02* (2006.01)
*F04D 7/00* (2006.01)
(Continued)

(52) U.S. Cl.
CPC ..... *F04D 7/00* (2013.01); *F04B 15/08* (2013.01); *F04D 7/02* (2013.01); *F04D 29/5893* (2013.01)

(58) Field of Classification Search
CPC ..... F04D 7/02; F04D 29/426; F04D 29/3893; F04B 37/08; F04B 2015/081; F04B 15/00; F04B 15/08; F04B 15/06; F04B 29/688; F04B 25/5893
(Continued)

(56) References Cited

U.S. PATENT DOCUMENTS 2,737,120 A * 3/1956 Ivanoff ..... F04D 1/063 122/406.1
3,666,375 A * 5/1972 Priest et al. ..... F04D 7/06 277/408
4,593,835 A * 6/1986 Kikkawa et al. ..... 222/131

FOREIGN PATENT DOCUMENTS

EP 0127752 A1 12/1984
JP 46-32899 B1 9/1971
JP 59-200091 A 11/1984

* cited by examiner

*Primary Examiner* — Charles Freay
*Assistant Examiner* — Philip Stimpert
(74) *Attorney, Agent, or Firm* — Wood, Phillips, Katz, Clark & Mortimer

(57) ABSTRACT

A cryogenic pump for liquefied gases is provided, which shortens precooling time, has a small loss of cryogenic liquefied gas, excels in pump efficiency, and is advantageous in cost. A motor 1 and an impeller 2 are coupled by a shaft 3 for transmitting a rotative drive force therebetween, and the motor 1 is arranged on an upper side and the impeller 2 is arranged on a lower side. The motor 1 and the impeller 2 exist in an enclosed space 14 where they are communicated with each other and into which the cryogenic liquefied gas is introduced. A heat adjusting unit 11 is provided between the motor 1 and the impeller 2, the heat adjusting unit maintaining existence of the impeller 2 in a liquid phase of the cryogenic liquefied gas and maintaining existence of the motor 1 in a gas phase of the cryogenic liquefied gas. Thus the submerging of the motor 1 in the liquid becomes
(Continued)

unnecessary, whereby the precooling time can be reduced remarkably and the loss of cryogenic liquefied gas due to vaporization caused by the submerging can be reduced, and in addition, the motor 1 itself can be configured at a comparatively low cost.

3 Claims, 10 Drawing Sheets

(51) Int. Cl.
*F04B 15/08* (2006.01)
*F04D 29/58* (2006.01)
(58) Field of Classification Search
USPC ..... 417/901
See application file for complete search history.

CRYOGENIC PUMP FOR LIQUEFIED GASES

TECHNICAL FIELD

The present invention relates to cryogenic pump for liquefied gases for transferring cryogenic liquefied gases.

BACKGROUND ART

Transfer of liquefied gases at a low temperature (liquefied gases of which boiling point is −150° C. or lower, such as liquid oxygen, liquid nitrogen, liquid argon, or liquefied natural gas (LNG)) by plumbing, is carried out by creating a difference in pressure by using a centrifugal pump, etc.

Conventional centrifugal pumps for cryogenic liquefied gases include the following.

(1) Shaft Seal Pump (Non-patent Document 1: Cryostar Internet Catalogue, Model GBSD)

(2) Submerged Pump (Non-patent Document 2: Nikkiso Co., Ltd., Cryogenic Pump Catalogue, Catalogue No. 2075R4, Non-patent Document 3: Cryostar Internet Catalogue, Model VS, and Patent Document 1: JP1994-288382A)

(3) Magnet-coupling-drive Sealless Pump (Non-patent Document 4: CS&P Cryogenic Internet Catalogue, Model Centrifugal Pump 2"×3"×6.7", and Patent Document 2: JP2001-514360A).

The detailed explanation of the above-mentioned pumps will be made.

(1) Shaft Seal Pump (Non-patent Document 1)

This is a pump of which an impeller for generating a difference in pressure of liquid exists in the cryogenic liquefied gas, while a motor for rotationally driving the impeller exists in the atmosphere. The impeller and the motor are coupled to each other, by a pump shaft penetrating through a housing. The cryogenic liquefied gas is filled in the housing for accommodating the impeller, and a shaft seal is utilized for the purpose of rotating the pump shaft penetrating through the housing, without leaking of cryogenic liquefied gas.

(2) Submerged Pump (Non-patent Document 2, Non-patent Document 3, and Patent Document 1)

This is a pump in which not only an impeller, but also a motor for rotationally driving the impeller, and a bearing all exist in cryogenic liquefied gas. The cryogenic liquefied gas is filled in a casing covering the entire pump, and a shaft seal is not used.

(3) Magnet-coupling-drive Sealless Pump (Non-patent Document 4, and Patent Document 1)

This is a pump in which an impeller exists in cryogenic liquefied gas, and a motor for rotationally driving the impeller exists in the atmosphere. The impeller and the motor are arranged in a liquid phase and a gas phase which are separated by a pressure bulkhead, respectively. A rotational force is transmitted between an impeller-side shaft and a motor-side shaft.

Here, in general, as the installation place of the pump, the pump may be installed on the ground as stationary pump equipment, or mounted on a vehicle (tank truck) as a mobile pump equipment. Additionally, usage of the pump includes a case of constant-operation, a case of being in a stand-by mode constantly and operating only when needed, and a case of standing by when needed and operating thereafter.

REFERENCE DOCUMENTS OF CONVENTIONAL ART

Patent Documents

Patent Document 1: JP1994-288382A
Patent Document 2: JP2001-514360A

Non-Patent Document

Non-patent Document 1: Cryostar Internet Catalogue, Model GBSD (http://www.cryostar.com/pdf/data-sheet/en/gbsd.pdf)

Non-patent Document 2: Nikkiso Co., Ltd., Cryogenic Pump Catalogue, Catalogue No. 2075R4

Non-patent Document 3: Cryostar Internet Catalogue, Model VS (http:www.cryostar.com/pdf/data-sheet/us/vs.pdf)

Non-patent Document 4: CS&P Cryogenic Internet Catalogue, Model Centrifugal Pump 2"×3"×6.7" (http://www.c-sphouston.com/industrial_cryogenic/centrifugal.php)

SUMMARY OF THE INVENTION

Problems to be Solved by the Invention

The most ordinary used type of pump is a shaft seal pump having a "shaft seal" for sealing while sliding a fixed unit and a rotative unit with each other. The greatest disadvantage of this type of pump is leaking of the cryogenic liquefied gas when the lifetime of shaft seal comes to the end due to abrasion thereof. When the leaked and spread cryogenic liquefied gas adheres to a human body, there is a risk of, for example, cryogenic burn injury, and a considerable amount of leakage would cause, not only a considerable loss of material, but also a deterioration of pump performance. Further, when combustible gas leaks, there is a risk of causing fire. Thus a pump called the "sealless pump," without having any shaft seal, have been used.

There are several types of "sealless pump," such as "submerged pump" in which structural parts including a motor unit are submerged in the cryogenic liquefied gas, and a pump using magnet-coupling and not having a penetrating part of a shaft.

However, according to the conventional sealless pump, since a rotative shaft is supported by a bearing submerged in the cryogenic liquefied gas, the bearing is to be used under a low temperature. Consequently, grease, namely an ordinary lubricant, cannot be used because the temperature becomes lower than the service temperature limit of the grease (for example, the lower service temperature limit of general-purpose grease commercially available for aircrafts is around −73° C.). Even when there is any lubricant capable of being used under a low temperature, since the bearing rotates while being submerged in the cryogenic liquefied gas, namely the subject of transfer, the lubricant flows into the cryogenic liquefied gas and becomes mixed in the gas as impurities. Therefore a bearing which is more expensive compared to ordinary bearings needs to be used, such as a bearing which is lubricated in the cryogenic liquefied gas, for example, a ceramic ball bearing or a stainless steel bearing, or which uses a solid lubricant.

Further, a frictional heat is caused by the rotation of the bearing. The "submerged pump" generates a heat by the rotation of the motor, and the "magnet-coupling pump" generates a heat by an eddy current. The heat directly increases the temperature of the cryogenic liquefied gas, whereby the cryogenic liquefied gas is vaporized, which results in larger loss of the material.

Further, according to the conventional submerged pump, the motor is also submerged in the cryogenic liquefied gas. Therefore, the motor using a material that is free from cryogenic embrittlement, such as stainless steel, and not iron which is used for ordinary motors, needs to be used, and the cost of the motor becomes higher.

Transfer of cryogenic liquefied gas by a pump requires "precooling," which is cooling of a part for accommodating the cryogenic liquefied gas in advance to become around the liquid temperature. This serves for preventing vaporization of the cryogenic liquefied gas in the pump during the operation of the pump, and also for lowering the suction lift of the pump called as "NPSH." When the precooling is insufficient, the cryogenic liquefied gas is vaporized in the pump and easily causes cavitation, which may give damage to the pump. Thus the precooling is a necessary preparation step to operate the cryogenic pump for liquefied gases.

The precooling as discussed above is carried out by introducing the cryogenic liquefied gas, namely the subject of transfer, inside of the pump before starting the operation. The time required for completing the precooling of all the parts which become in contact with the cryogenic liquefied gas depends considerably on the mass of the parts for which the precooling is required. The conventional sealless pump requires precooling, not only of the impeller, but also of the motor and the bearing, whereby the mass of the parts submerged in the cryogenic liquefied gas becomes larger. Consequently, a larger loss of the cryogenic liquefied gas vaporized during the precooling is caused, and the time required for the precooling also becomes longer.

On the other hand, since the shaft seal pump needs no precooling of the motor, the mass of the parts requiring precooling is smaller, and therefore the loss is small, and the precooling time can become comparatively short. However, with regard to a horizontal-type shaft seal pump, too much precooling results in drop in temperature, via the pump shaft, inside of the motor. The shaft is sometimes cooled excessively to below the ambient conditions for using of the motor (between −20° C. and −30° C.), which results in deterioration of or giving damage to the bearing.

With reference to the relation to the equipment on which the pump is installed, when the submerged pump is used, the pump is used in the upright style, and therefore the liquid level of the suction-side tank requires at least "the height of the pump unit+the motor unit" or more. This is because the motor is cooled by the liquid of itself (liquefied gas), and at the same time the liquid of itself (liquefied gas) is used as a cooling and lubrication agent of the bearing. However, especially in the case of tank trucks, the tank is mounted horizontally. Accordingly, the liquid level of the suction-side tank cannot be set sufficiently high, and the adoption of the submerged pump thereto is substantially difficult. Even in the case of tanks installed on the ground, the transferrable amount of liquid of the submerged pump is smaller than that of other types of pump, and the efficiency is poor.

The problems of the respective conventional pumps are summarized as below.

(1) Shaft Seal Pump

The shaft seal pump has the shaft seal for sealing while sliding the fixed unit and the rotative unit with each other, and therefore the shaft seal will be worn out due to abrasion. When the lifetime of shaft seal comes to the end due to the abrasion thereof, the cryogenic liquefied gas leaks out of the shaft seal part.

According to an ordinary type of shaft seal pump, the atmosphere opening part of the pump shaft is short in size. Therefore, when the pump unit is cooled too much, due to heat transfer by the pump shaft, the bearing of the motor, or the like is cooled below the ambient conditions for using thereof, may result in deterioration of or giving damage to the bearing.

For the purpose of preventing the above problem, in some cases the warming of the pump shaft is heated by spraying gas or water at about a normal temperature, or by attaching a heater in the vicinity of the motor shaft bearing section.

(2) Submerged Pump

Since the bearing is in the cryogenic liquefied gas, the temperature is out of the service temperature limit range of grease, namely an ordinary lubricant, and the grease cannot be used. Even when there is an available lubricant, since the bearing rotates while being submerged in the cryogenic liquefied gas, namely the subject of transfer, the lubricant flows into the cryogenic liquefied gas and becomes impurities. Therefore an expensive bearing needs to be used, such as a bearing for being lubricated in the cryogenic liquefied gas, which is based on a ceramic ball bearing or a stainless steel bearing, or a bearing using a solid lubricant.

Because the whole part including the motor unit requires to be in the cryogenic liquefied gas, an expensive material that is free from cryogenic embrittlement, such as stainless steel is required to be used, and not iron material used for ordinary motors, and the cost of the motor becomes higher.

Because the whole part including the motor unit requires to be in the cryogenic liquefied gas, the liquid level of the suction-side tank requires to be the pump unit+the motor unit or higher.

Because the whole part including the motor unit requires to be in the cryogenic liquefied gas, the mass of the structural member requiring precooling becomes larger. Consequently the time for the precooling becomes longer, and the loss of cryogenic liquefied gas due to vaporization becomes larger.

The heat from the motor and the bearing during the operation is directly absorbed in the cryogenic liquefied gas, and consequently the loss of cryogenic liquefied gas due to vaporization is large also during the operation of the pump.

The temperature of a pressure-resistance wall of the motor unit also becomes low, and therefore the pressure-resistance wall requires an expensive, cryogenic-tolerant material such as aluminum or stainless steel, and the cost of the wall becomes higher.

(3) Magnet-coupling-drive Sealless Pump

Since the bearing is in the cryogenic liquefied gas, the temperature is out of the service temperature limit range of grease, namely an ordinary lubricant, and the grease cannot be used. Even when there is an available lubricant, since the bearing rotates while being submerged in the cryogenic liquefied gas, namely the subject of transfer, the lubricant flows into the cryogenic liquefied gas and becomes impurities. Therefore an expensive bearing needs to be used, such as a bearing for being lubricated in the cryogenic liquefied gas, which is based on a ceramic ball bearing or a stainless steel bearing, or a bearing using a solid lubricant.

Since the pressure bulkhead existing between the respective parts of the magnet-coupling becomes in contact with the cryogenic liquefied gas, a metal material is used such as a stainless steel, capable of being used in the cryogenic liquefied gas. However, since the magnets rotate sandwiching the metal-made pressure bulkhead at the center, the eddy current occurs at the pressure bulkhead. This causes heat and a power loss.

Because the magnet-coupling part also requires to be in the cryogenic liquefied gas, the mass of the structural member requiring precooling becomes larger. Consequently the time for the precooling becomes longer, and the loss of cryogenic liquefied gas due to vaporization becomes larger.

The heat by the eddy current and also the heat from the bearing are directly absorbed in the cryogenic liquefied gas during the operation, and consequently the loss of cryogenic liquefied gas due to vaporization becomes larger also during the operation of the pump.

The present invention is made to solve the above problems, and has an object to provide a cryogenic pump for liquefied gases, in which, a precooling time can be shortened although being a sealless pump, a pump efficiency is excellent because of the small loss of the cryogenic liquefied gas, the minimum liquid level required for the operation is lower, and the production cost is advantageous.

Means for Solving the Problem

To achieve the objects mentioned above, a cryogenic pump for liquefied gases of the present invention is provided, which applies a pressure difference to cryogenic liquefied gas so as to pump-transfer the gas by rotationally driving an impeller by a motor. The motor and the impeller are coupled to each other by a rotation transmitting means for transmitting the rotative drive force therebetween. The motor and the impeller are arranged so that the motor is positioned on an upper side and the impeller is positioned on a lower side. The motor and the impeller are respectively exist in an enclosed space where the motor and the impeller communicate with each other and into which the cryogenic liquefied gas is introduced. A heat adjusting unit is provided between the motor and the impeller, the heat adjusting unit maintaining existence of the impeller in a liquid phase of the cryogenic liquefied gas and maintaining existence of the motor in a gas phase of the cryogenic liquefied gas.

Effects of the Invention

According to the cryogenic pump for liquefied gases of the present invention, since the heat adjusting unit is provided between the motor and the impeller, the impeller is maintained in the liquid phase of the cryogenic liquefied gas, and the motor is maintained in the gas phase of the cryogenic liquefied gas. Accordingly, the motor does not need to be submerged in the liquid, thus the precooling time can be shortened remarkably, whereby the loss of cryogenic liquefied gas due to vaporization can also be reduced. In addition, the motor itself can be made of comparatively low-cost material, and this is advantageous in production cost. Further, since the heat of the motor does not give any direct effect the cryogenic liquefied gas, the loss of cryogenic liquefied gas due to vaporization during the operation of the pump is reduced remarkably, and the efficiency of pump operation improves. Further, since a shaft seal having a problem of abrasion and magnet-coupling having a problem of eddy current conventionally are not used, any of such problems will not occur. Further, since the motor is maintained in the gas phase, the liquid level of the suction-side tank is sufficient as long as it is the height of the impeller part, and the height of the motor unit does not need to be considered. Thus the minimum liquid level required for the operation can be lowered.

In the present invention, the enclosed space may be comprised to include a space for the motor, a space for the impeller, and a space for the rotation transmitting means, each forming a part of the enclosed space, and the heat adjusting unit may have the rotation transmitting means space and a part of the rotation transmitting means existing therein.

Accordingly, since the heat adjusting unit is formed by utilizing the structure required for transmitting the rotational force from the motor to the impeller, there is no structural waste and cost increase can be avoided, and at the same time, the motor can securely exist in the gas phase, and the impeller can securely exist in the liquid phase.

In the present invention, the heat adjusting unit may further have a heat adjusting housing for forming the rotation transmitting means space, and a heater for giving heat to the heat adjusting housing.

Accordingly, the motor is arranged above the heat adjusting unit, and the impeller is arranged below the heat adjusting unit. Thus the motor can securely exist in the gas phase, and the impeller can securely exist in the liquid phase.

In the present invention, the rotation transmitting means may have one or two or more shafts provided coaxially to a rotational axis of the motor and a rotational axis of the impeller.

Accordingly, a secure heat adjustment is carried out while the structure for transmitting the rotational force from the motor to the impeller is simplified as much as possible. The motor can securely exist in the gas phase and the impeller can securely exist in the liquid phase without causing a structural waste.

In the present invention, the shaft may be pivoted by a bearing existing in the gas phase within the enclosed space.

Accordingly, since the bearing exists in the gas phase, grease, namely an ordinary lubricant, can be used, and there is no risk that the lubricant flows into the cryogenic liquefied gas and becomes impurities. Further, the bearing itself can be made of comparatively low-cost material, and this is advantageous in production cost. In addition, since the bearing is arranged in a part maintained as the gas phase by the heat adjusting unit, there is no risk of damages and deterioration due to excessive cooling of the bearing.

MODES FOR CARRYING OUT THE INVENTION

Next, embodiments for carrying out the present invention will be discussed.

Figure 1:
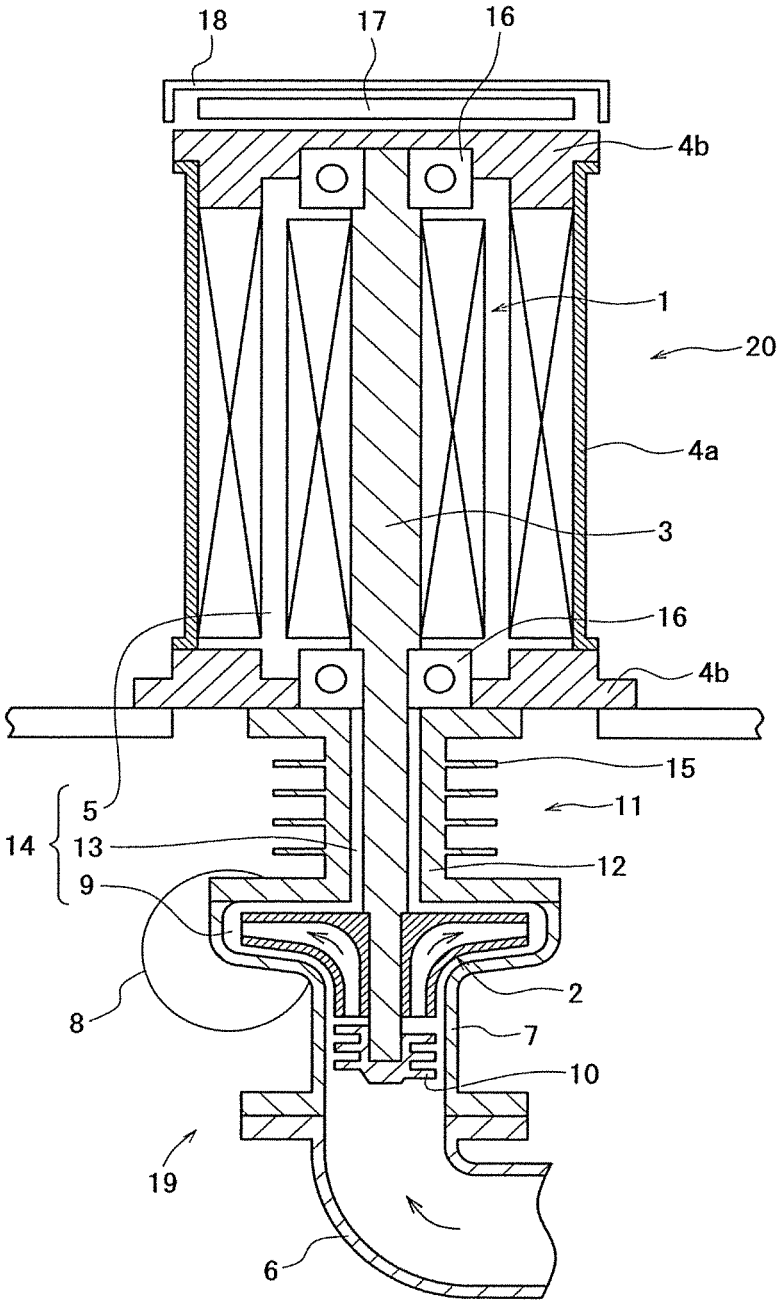
FIG. 1 is a view showing an overall structure of a cryogenic pump for liquefied gases according to a first embodiment of the present invention.

FIG. 1 is a schematic view showing a first embodiment of a cryogenic pump for liquefied gases of the present invention.

This is a cryogenic pump for liquefied gases for applying a pressure difference to cryogenic liquefied gas so as to pump-transfer the gas by rotationally driving an impeller 2 by a motor 1.

The motor 1 may be manufactured based on an ordinary motor, for example a DC motor or a three-phase induction motor. Other than this, when a PM motor (permanent magnet motor) is used, the energy efficiency of the pump can improve.

Further, outer walls of the motor 1 are surrounded by pressure-resistance walls 4*a* and 4*b*, and an inner space of the pressure-resistance walls 4*a* and 4*b* is formed to be a motor space 5 for accommodating the motor 1. A motor unit 20 is formed, including the pressure-resistance walls 4*a* and 4*b* and the motor 1 discussed above.

The impeller 2 is positioned in a volute housing 7 communicating with an introduction channel 6 for introducing the cryogenic liquefied gas therein, and is driven rotationally. The rotation of the impeller 2 in the volute housing 7 generates a centrifugal force, and applies the pressure difference to the cryogenic liquefied gas introduced from the introduction channel 6. Then the cryogenic liquefied gas is discharged from a discharge part 8 provided on an outer circumferential part of the volute housing 7. A space inside the volute housing 7 serves as an impeller space 9 accommodating the impeller 2. A reference numeral 10 in FIG. 1 refers to an inducer 10 for facilitating flowage of the cryogenic liquefied gas. A pump unit 19 is formed, including the impeller 2, the volute housing 7 and the inducer 10.

The motor 1 and the impeller 2 are coupled to each other by a rotation transmitting structure/means for transmitting the rotative drive force therebetween. According to the present example, a single common shaft 3 serving as the rotation transmitting means, used coaxially to a rotational axis of the motor 1 and a rotational axis of the impeller 2. Note that, the shaft 3 is not limited to a single type which is commonly used for the motor 1 and the impeller 2, and the shaft for the motor 1 and the shaft for the impeller 2 may be provided separately and coupled by, for example, coupling to each other.

A certain amount of space is secured between the motor 1 and the impeller 2, and a heat adjusting housing 12 covers a part in which the shaft 3 passes through the space. An inner space of the heat adjusting housing 12 is formed to be a shaft space 13 for accommodating the part of the shaft 3.

The motor 1, the impeller 2 and the shaft 3 respectively exist in an enclosed space 14 where they communicate with each other and into which the cryogenic liquefied gas is introduced. According to the present example, the enclosed space 14 is comprised to include the motor space 5, the impeller space 9 and the shaft space 13, respectively forming a part of the enclosed space 14. The shaft space 13 serves as the rotation transmitting means space. The motor space 5, the impeller space 9 and the shaft space 13 communicate with each other. Accordingly, a single pressure-enclosed space is formed by the volute housing 7, the heat adjusting housing 12 and the pressure-resistance walls 4*a* and 4*b* of the motor 1.

With reference to the motor 1 and the impeller 2, the motor 1 is positioned on an upper side and the impeller 2 is positioned on a lower side.

Further, a heat adjusting unit 11 between the motor 1 and the impeller 2, for maintaining existence of the impeller 2 in a liquid phase of the cryogenic liquefied gas and also for maintaining existence of the motor 1 in a gas phase of the cryogenic liquefied gas.

The heat adjusting unit 11 has the shaft space 13 and the part of the shaft 3 existing therein. Further, the heat adjusting unit 11 further has the heat adjusting housing 12 for forming the shaft space 13, and fins 15 serving as a heat giving structure/means for giving heat to the heat adjusting housing 12.

As discussed above, the heat adjusting unit 11 is provided in an atmosphere in the space part formed between the motor 1 and the impeller 2. The impeller 2, the heat adjusting unit 11 and the motor 1 are arranged in this order from the lower side. Accordingly, because of the properties that cool air goes down and hot air goes up, the temperature range can be divided effectively, which corresponds to the structural arrangement of the pump, where the impeller 2 in the lower part of the pump is positioned in a cryogenic section, the heat adjusting unit 11 in the intermediate part is positioned in the low/normal-temperature section, and the motor 1 in the upper part is positioned in the normal-temperature section.

Fins on the heat adjusting unit 11 cause heat to conduct between the atmosphere in which the heat adjusting unit 11 resides and the rotation transmitting structure space through the heat adjusting housing 12.

The shaft 3 is pivoted by bearings 16 existing in the gas phase of the enclosed space 14. Thus in the bearings 16, the bearing of the motor 1 is also used as a pump bearing, and the single shaft 3 is used as a pump shaft and also as a motor shaft.

A cooling fan 17 rotationally interlocked with the motor 1 is arranged above the motor 1, for cooling the motor 1. The reference numeral 18 in FIG. 1 refers to a fan cover 18.

With such a structure, the cryogenic liquefied gas is sucked into the pump from the part with the inducer 10 at the bottom of FIG. 1, and is given a moving force by the impeller 2, and is discharged from the discharge part 8. Once the cryogenic liquefied gas enters the inside of the pump, there is no outlet but only the discharge part, and the cryogenic liquefied gas will not move towards the motor 1 because of the dead-end structure of the enclosed space 14.

Thus, because of the property of natural heat convection that cool air goes down and hot air goes up, and also because the cryogenic liquefied gas does not move towards the motor 1, for example, it can be divided that the pump structural part including the lower part impeller 2 as the cryogenic section, the heat adjusting unit 11 in the intermediate part as the low/normal-temperature section, and the part of the motor 1 in the upper part as the normal-temperature section.

Accordingly, the cryogenic liquefied gas is introduced from the introduction channel 6 and flows towards the discharge part 8, and the impeller space 9 for accommodating the impeller 2 is filled with the cryogenic liquefied gas. For example, the gas is kept at the temperature of −150° C. or lower, and is maintained in the liquid phase state. On the other hand, the motor space 5 for accommodating the motor 1 is kept at around the normal temperature, for example at −20° C. or higher, and therefore is filled with the vaporized gas of the cryogenic liquefied gas, whereby the gas phase state is maintained. The temperature of the shaft space 13 is within an intermediate range between the temperature of the motor space 5 and the temperature of the impeller space 9, and a temperature gradient is formed therein.

The section filled with the liquid phase corresponds to that from the introducing channel 6 to the pump unit 19. In particular, the liquid phase section corresponds to that of minimum essential parts only, such as the volute housing 7, a bottom part of the heat adjusting housing 12, the impeller 2, the part of the shaft 3 and the inducer 10. The pump unit 19 is arranged in the lower area, and the section filled with the liquid phase is limited up to the pump unit 19. Consequently, a liquid level in the pump may be lowered to be the level of the discharge part 8.

As discussed above, the space between the motor 1 and the impeller 2, in which the heat adjusting unit 11 is formed, is set so that the motor 1 can be maintained in the gas phase, and the impeller 2 can be maintained in the liquid phase. This is set arbitrarily according to several factors, for example, the diameter of the shaft 3, the thickness of the heat adjusting housing 12, the type of the respective materials, etc.

For example, when the type of material is SUS304, the atmosphere temperature is 20° C., the cryogenic liquefied gas is liquid nitrogen, and the temperature of the motor unit 20 is 5° C. or higher, and further, provided that the diameter of the shaft 3 is 30 mm, then the distance of the heat adjusting unit 11 may be 300 mm or more, and the thickness of the heat adjusting housing 12 here may be 15 mm or less.

The appropriate length of the heat adjusting unit 11 leads to appropriate setting of the length of the shaft 3 and also the length of the heat adjusting housing 12, corresponding to the heat adjusting unit 11. Through theoretical calculation and experiments, it is possible to obtain, for example, the length, the diameter of the shaft 3, the thickness of the heat adjusting housing 12, by which an inlet of the motor unit 20 becomes an appropriate set temperature.

As discussed above, according to the present embodiment, for the purpose of eliminating the conventional shaft seal, the inside of the motor unit 20 and the inside of the pump unit 19 form the enclosed space 14 where they are communicated with each other, and thus the shaft 3 does not penetrate into the atmosphere. For this purpose, the pressure-resistance walls 4*a* and 4*b* serve as the outer walls of the motor unit 20.

Moreover, the pump is installed in the upright direction, and the appropriate heat adjusting unit 11 divides the sections into the liquid phase section and the gas phase section, whereby the bearing 16 in the motor 1 are kept at the normal temperature (in this context, "normal temperature" means a usage environment temperature of common motors, which is approximately between −20° C. and 40° C.). Accordingly, the bearing 16 will not become in direct contact with the cryogenic liquefied gas, and therefore, for example, a low cost bearing made of iron for which common grease is used as the lubricant may be used.

Further, the motor unit 20 will not be in direct contact with the cryogenic liquefied gas, and therefore a common and low cost iron material may be used. The cooling fan 17 interlocked with the motor 1 cools down the heat of the motor unit 20. Moreover, the pressure-resistance walls 4*a* and 4*b* serve as the outer walls of the motor unit 20, and accordingly, there is no metal bulkhead between driver magnets, which would be the cause of eddy current.

Further, the cryogenic liquid phase section corresponds only to the pump unit 19, and thus the mass of the structural members with which the cryogenic liquefied gas becomes in contact has been reduced to the least possible. Out of specific major members, the cryogenic liquefied gas becomes in contact with only the volute housing 7, the bottom part of the heat adjusting housing 12, the inducer 10, the impeller 2 and the tip of the shaft 3.

The pump is installed in the upright direction, and the appropriate heat adjusting unit 11 divides the pump into the liquid phase section at the cryogenic and the gas phase section at the normal temperature. Thus the bearing 16 in the motor 1 will not be affected by the cooling of the pump.

Further, the liquid level of the cryogenic liquefied gas entering the inside of the pump is lowered down to the level of the discharge part 8. Further, to form the pressure-resistance structure for the outer walls of the motor 1, the thickness is set to a required thickness that can bear a design pressure, or thicker, that is, a minimum thickness of or thicker than that prescribed by High Pressure Gas Safety Law. Moreover, the same shaft 3 is used for the motor 1 and the impeller 2, and the shaft 3 is supported only by the bearings 16 in the motor 1.

In detail, a seal material, such as gasket or O-ring, is used for each of joint parts of the pressure-resistance walls 4*a* and 4*b* of the motor unit 20, the volute housing 7 and the heat adjusting housing 12, and an enclosure structure is secured by fastening flanges by bolts, or by fastening with a screw-thread structure.

As discussed above, according to the cryogenic pump for liquefied gases of the present embodiment, there are following effects.

The inside of the pump unit 19, the inside of the heat adjusting unit 11 and the inside of the motor unit 20 form the enclosed space 14 where they communicate with each other. Thus there is no part in which the shaft penetrates through the atmosphere, and consequently the shaft seal is not required.

The motor unit 20, the appropriate heat adjusting unit 11 and the pump unit 19 are arranged in this order, in the upright direction from the upper part. Therefore the motor unit 20 and the bearing 16 can be kept, for example, at the normal temperature, and the motor 1 and the bearing 16 may be made of ordinary material such as iron steel. Further, a common lubricant, such as grease, may be used for the bearing 16.

The motor unit 20, the appropriate heat adjusting unit 11 and the pump unit 19 are arranged in this order, in the upright direction from the upper part. Therefore the motor unit 20 and the bearing 16 may be kept, for example at the normal temperature, and the heat generated therefrom will not be absorbed directly in the cryogenic liquefied gas. Consequently the amount of lost vaporized gas can be reduced.

The motor unit 20, the appropriate heat adjusting unit 11 and the pump unit 19 are arranged in this order, in the upright direction from the upper part. Further, the motor unit 20 is enclosed. Therefore the liquid level of the cryogenic liquefied gas in the pump is limited to the level of the discharge part 8, and only the pump unit 19 can become the cryogenic liquid phase section. Accordingly, the major structural members of the pump which become in contact with the cryogenic liquefied gas are minimized to the volute housing 7, the bottom part of the heat adjusting housing 12, the inducer 10, the impeller 2 and the tip of the shaft 3. Thus the loss of vaporized gas generated during precooling of the pump may be reduced, and the precooling time may be shortened. Further, since the liquid level of the entering cryogenic liquefied gas may be lowered, the lower limit of the liquid level of the suction-side tank may also be lowered.

Because of the appropriate of heat adjusting unit 11, the pump unit 19 can exist in the liquid phase at the low temperature, and the motor unit 20 may exist in the gas phase, for example at the normal temperature.

Figure 2:
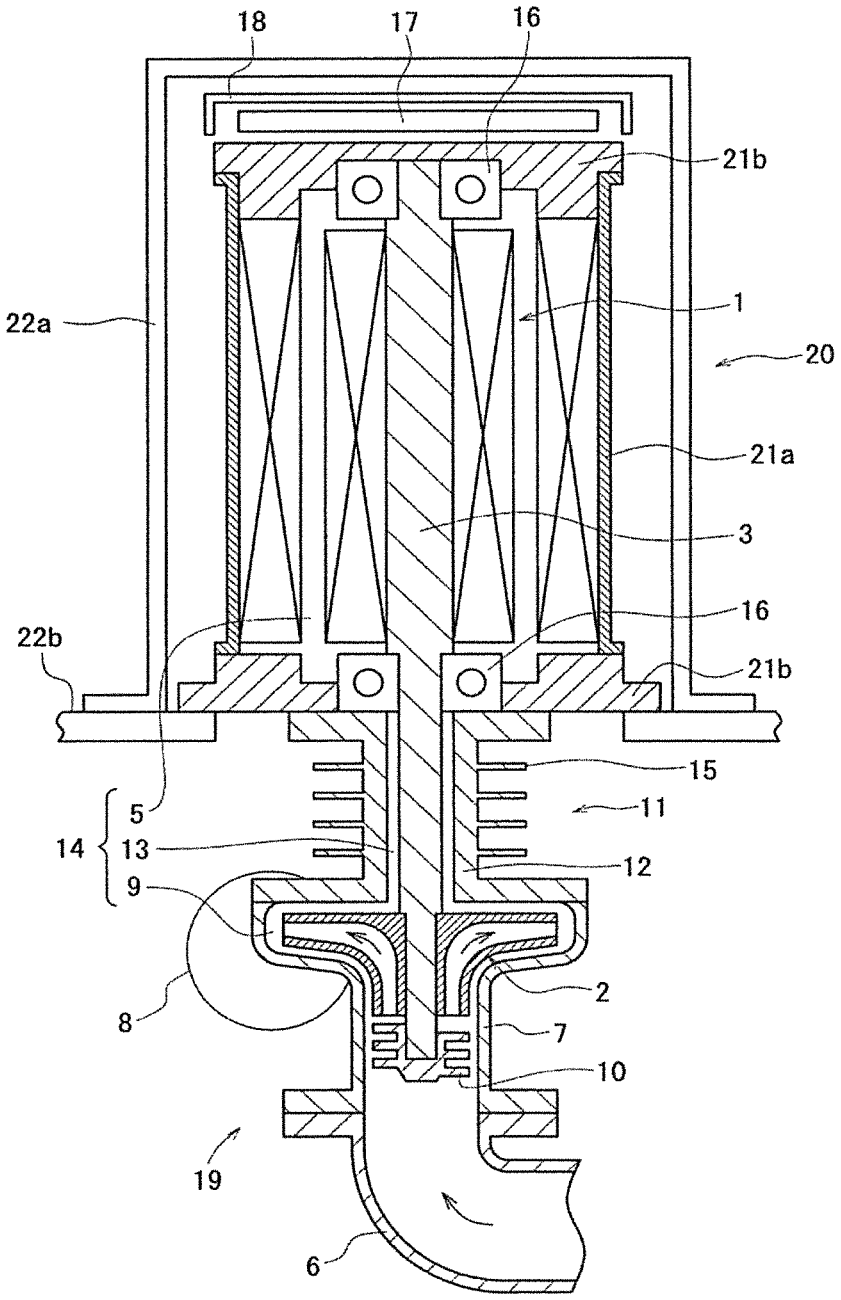
FIG. 2 is a view showing an overall structure of a cryogenic pump for liquefied gases according to a second embodiment.

FIG. 2 illustrates a second embodiment of the present invention.

According to this example, the motor unit 20 is not provided with the pressure-resistance walls 4*a* and 4*b*. Thus, the motor 1 is covered by outer walls 21*a* and 21*b* having no pressure-resistance structure, and thus the motor unit 20 is configured. The outside of the motor unit 20 is covered by separate pressure walls 22*a* and 22*b*. Other structure is similar to that of the first embodiment, and the same reference numerals are allotted to the similar parts. This example also has similar functions and effects as those of the first embodiment.

Figure 3:
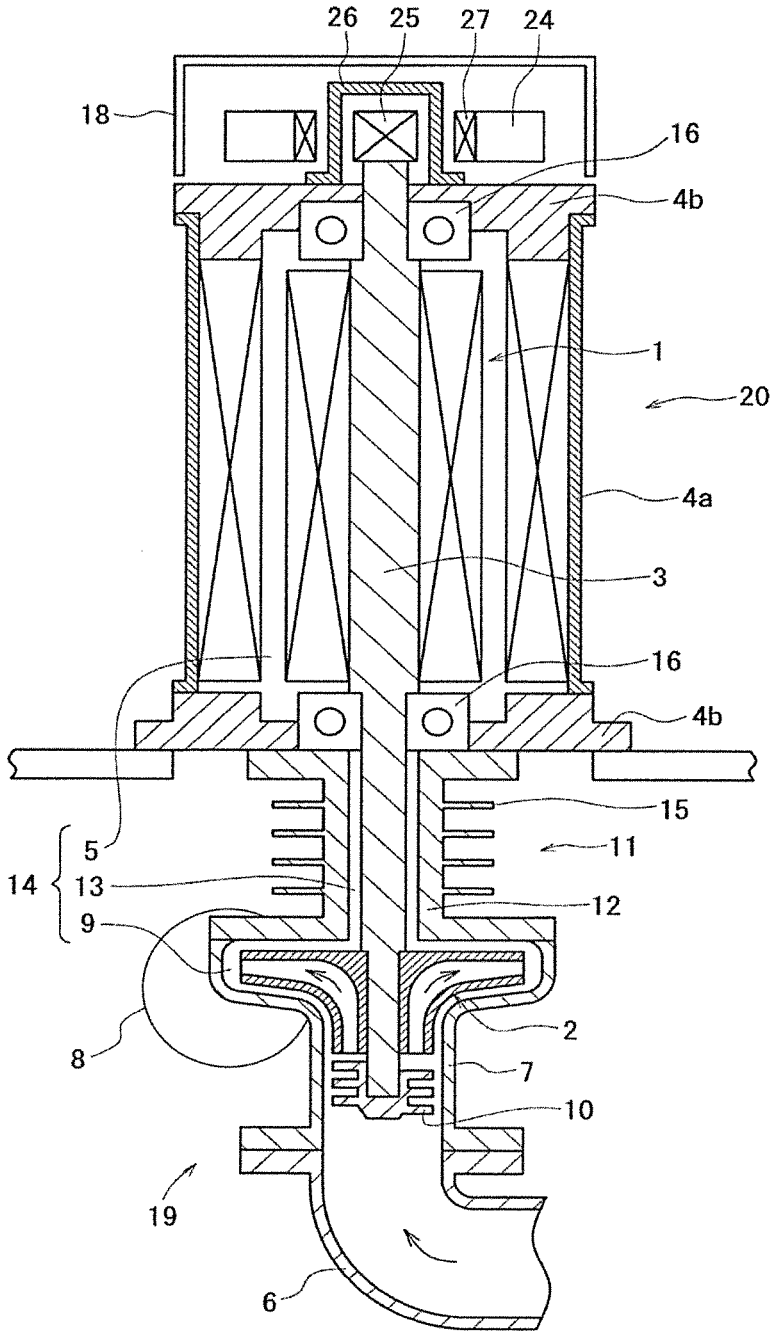
FIG. 3 is a view showing an overall structure of a cryogenic pump for liquefied gases according to a third embodiment.

FIG. 3 illustrates a third embodiment of the present invention.

According to this example, a fan 24 positioned outside of the motor unit 20 is driven by magnet-coupling for cooling the motor 1. Thus, a part of the shaft 3 on the side of the motor 1 penetrates through the pressure-resistance wall 4*b* and projecting to the outside, and an inner magnet 25 is attached to the projecting part of the shaft 3. A pressure-resistance cover 26 covers to enclose the space around the inner magnet 25, and the fan 24 provided with an outer magnet 27 is arranged outside of the pressure-resistance cover 26. Other structure is similar to that of the first embodiment, and the same reference numerals are allotted to the similar parts. This example also has similar functions and effects as those of the first embodiment.

Note that, the cooling of the motor 1 may also be carried out, for example, by using a separately-placed cooling fan interlocked with the motor, using a cooling fan installed separately, or applying cooling by water.

According to each embodiment as discussed above, the length of the heat adjusting unit 11 can be shortened by heating the heat adjusting unit 11 or the motor unit 20 by the heat giving means, etc. In addition, when any material having low heat conductivity is used wholly or partially, the length of the heat adjusting unit 11 can be shortened. Also these cases can have similar functions and effects.

According to each embodiment as discussed above, the examples that one or two shafts are used as the rotation transmitting means are discussed. However, the present invention is not limited to these examples, and any other means may be used as long as the rotation of the motor 1 is transmitted to the impeller 2. For example, the shaft for the motor 1 and the shaft for the impeller 2 may be coupled by gear, chain or belt, so that the rotation is transmitted to each other.

Next the appropriate length (distance) of the heat adjusting unit 11 will be discussed.

The appropriate length of the heat adjusting unit 11 is determined by appropriately sets the length of the shaft 3 and also the length of the heat adjusting housing 12, corresponding to the heat adjusting unit 11. Through theoretical calculation and experiments, it is possible to obtain, for example, the length, the diameter of the shaft 3, the thickness of the heat adjusting housing 12, by which the inlet of the motor unit 20 becomes an appropriate set temperature.

For the purpose of determining the appropriate length of the heat adjusting unit 11 for dividing the sections into the liquid phase at the low temperature and the gas phase at the normal temperature, a temperature distribution experiment of the shaft 3 is conducted. The result will be discussed in detail as below with reference to Table 1. In relation to the diameter of the shaft 3, a necessary distance from the surface of liquid nitrogen is obtained at a temperature range between −30° C. and 10° C.

The experiment is conducted with regard to the temperature variation according to the shaft diameter and heat transfer in a state that the tip of the shaft 3 is submerged in the liquid nitrogen, and with regard to the temperature distribution in a temperature stable state in relation to the diameter of the shaft 3.

(Experiment Conditions)

Pump Shaft: SUS304 round bars having the same material property are used.

Shaft Diameter: diameter 10 mm, 20 mm and 30 mm are used.

Atmosphere Temperature: room temperature (between 20 and 22° C.)

Atmosphere Environment: natural convection state

Outside Temperature: 20° C.

(Measurement Device)

Temperature Measurement and Recording: Portable Multi-Logger ZR-RX40 (manufactured by OMRON)

Thermocouple: K-type thermocouple (Experiment Method)

Figure 4:
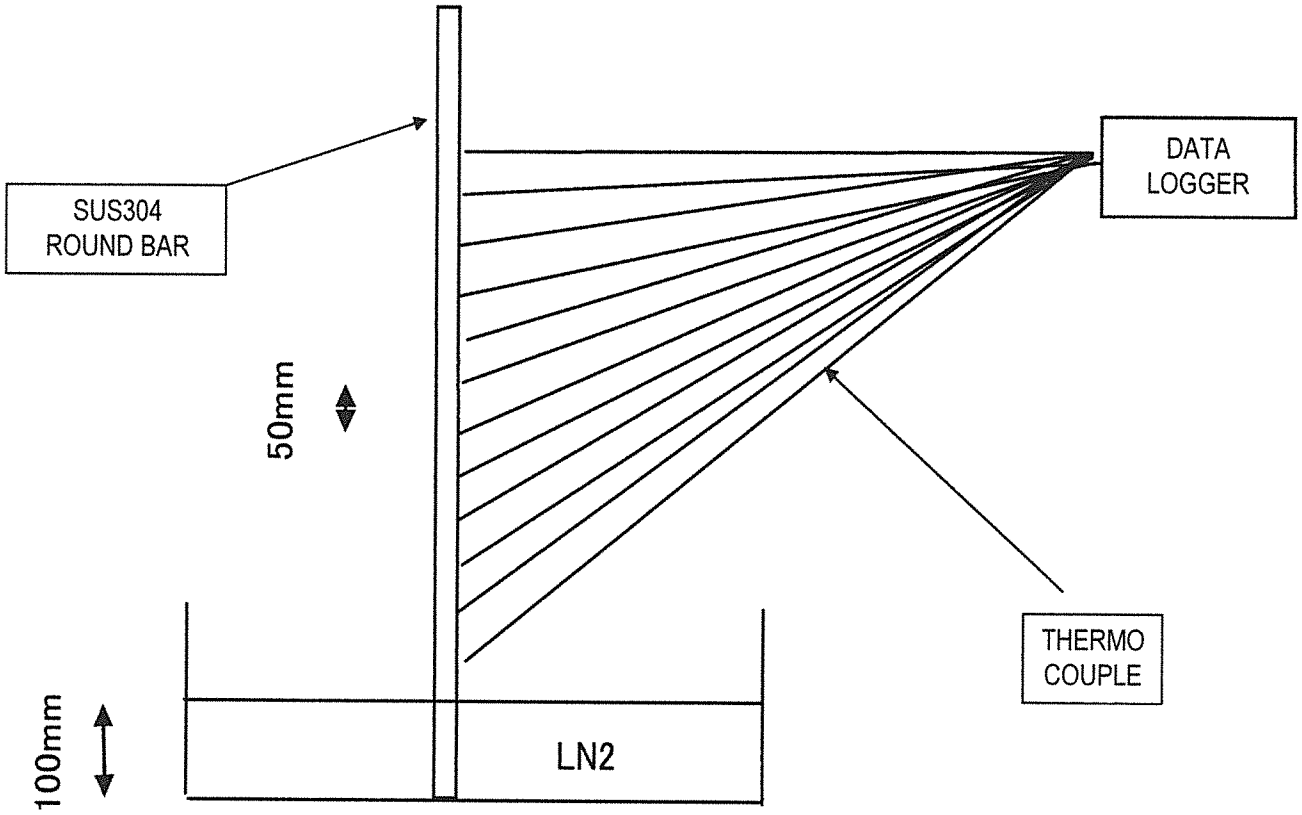
FIG. 4 is a schematic view showing a method of an experiment.

FIG. 4 is a schematic view showing a method of the experiment.

(1) On each of the SUS304 round bars having the diameter of 10 mm, 20 mm and 30 mm, respectively, thermocouples are attached to positions at 0.15 m, 0.20 m, 0.25 m 0.30 m, 0.35 m, 0.40 m, 0.45 m, 0.50 m, 0.55 m and 0.60 m, respectively from a lower tip of the SUS304 round bar.

(2) The SUS304 round bar is submerged in the liquid nitrogen by 0.10 m from the tip. The liquid nitrogen is supplemented constantly so that the surface of liquid nitrogen is at the position of 0.10 m from the tip of the round bar.

(3) The temperature is measured and recorded, starting from the time immediately after the submerging in the liquid nitrogen. The measurement is conducted at the positions of 50 mm to 500 mm from the surface of liquid nitrogen, at intervals of 50 mm.

(Measurement Result)

Figure 5:
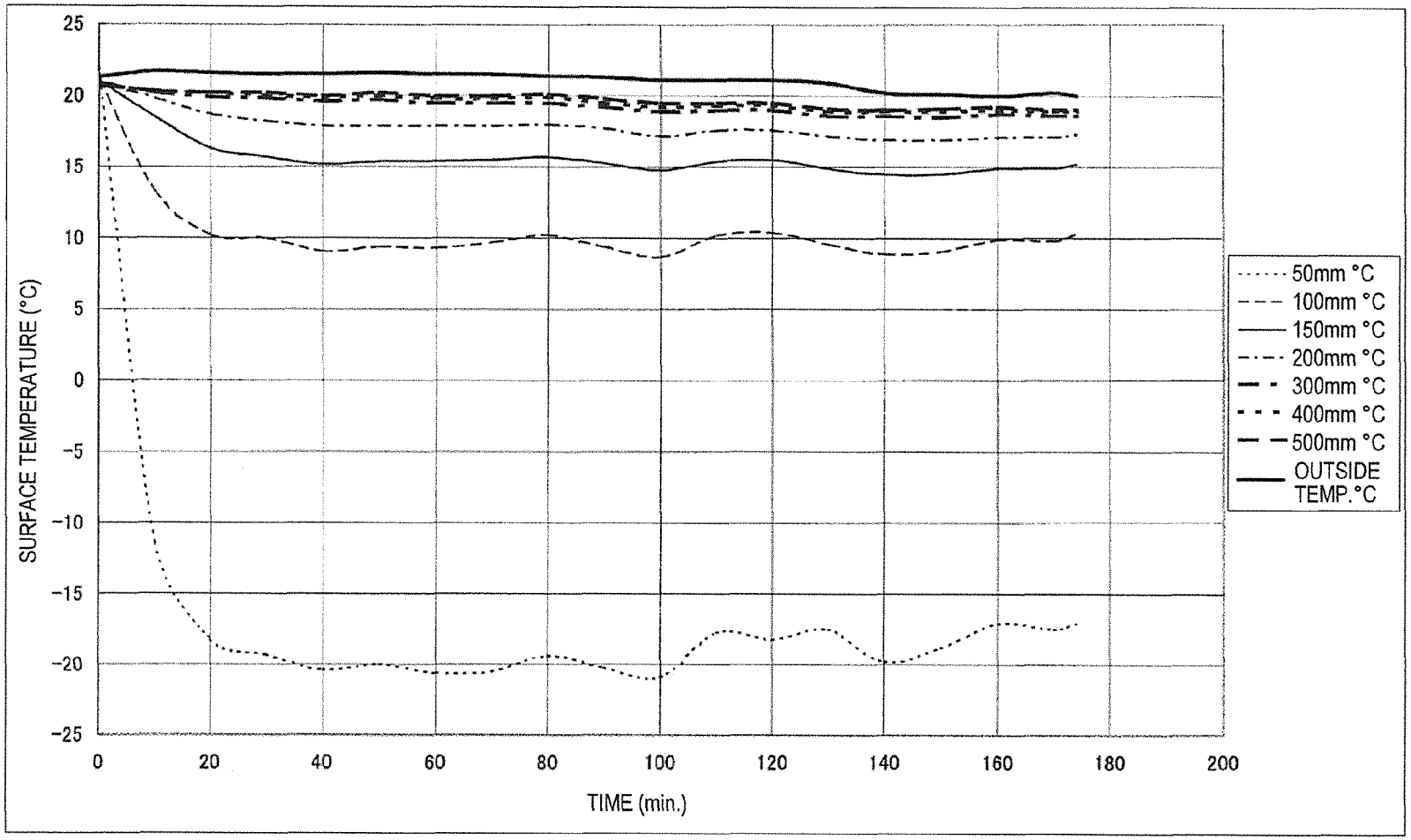
FIG. 5 is a graphic chart showing variations of a surface temperature of a SUS304 round bar having the diameter of 10 mm.

FIG. 5 shows the variations of surface temperature of the SUS304 round bar having the diameter of 10 mm (at the respective distances from the liquid surface).

Figure 6:
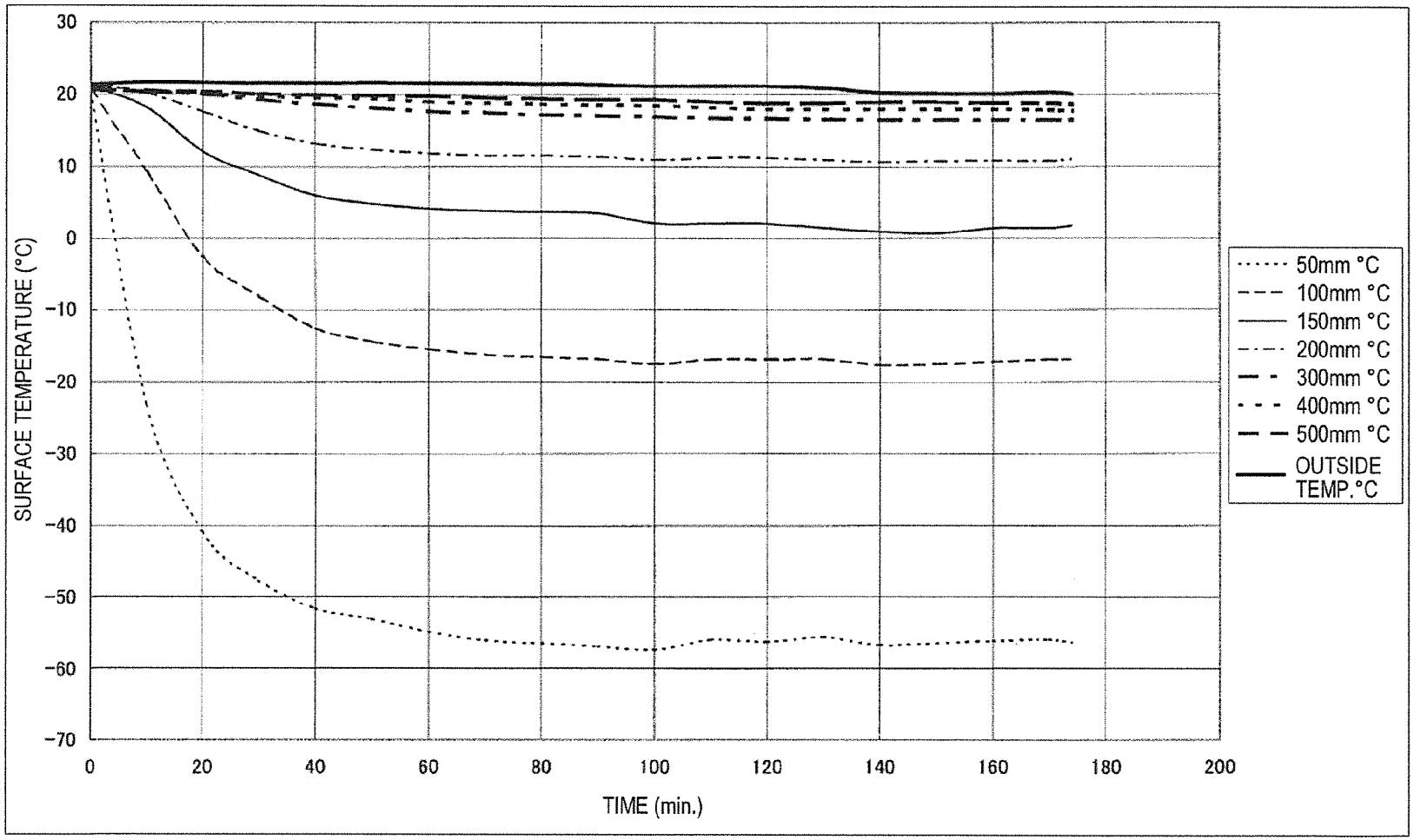
FIG. 6 is a graphic chart showing variations of the surface temperature of a SUS304 round bar having the diameter of 20 mm.

FIG. 6 shows the variations of surface temperature of the SUS304 round bar having the diameter of 20 mm (at the respective distances from the liquid surface).

Figure 7:
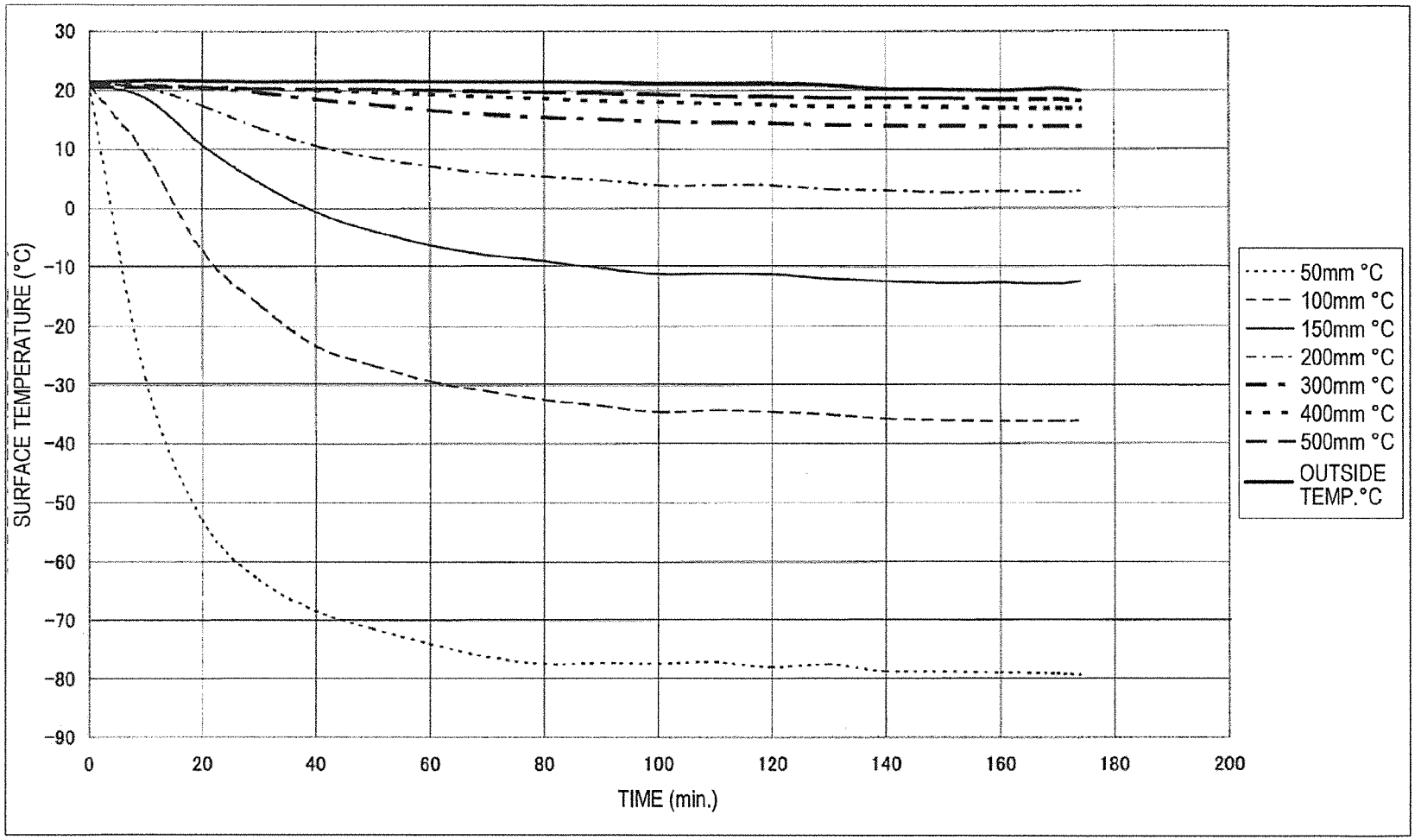
FIG. 7 is a graphic chart showing variations of the surface temperature of a SUS304 round bar having the diameter of 30 mm.

FIG. 7 shows the variations of surface temperature of the SUS304 round bar having the diameter of 30 mm (at the respective distances from the liquid surface).

(Summary of Temperature Variation According to Shaft Diameter and Heat Transfer)

With regard to the SUS304 round bar of which the diameter is 10 mm, the temperature variation became stable at about 40 minutes after starting the experiment.

With regard to the SUS304 round bar of which the diameter is 20 mm, the temperature variation become stable, about 100 minutes after starting the experiment.

With regard to the SUS304 round bar of which the diameter is 30 mm, the temperature variation become stable, about 150 minutes after starting the experiment.

Figure 8:
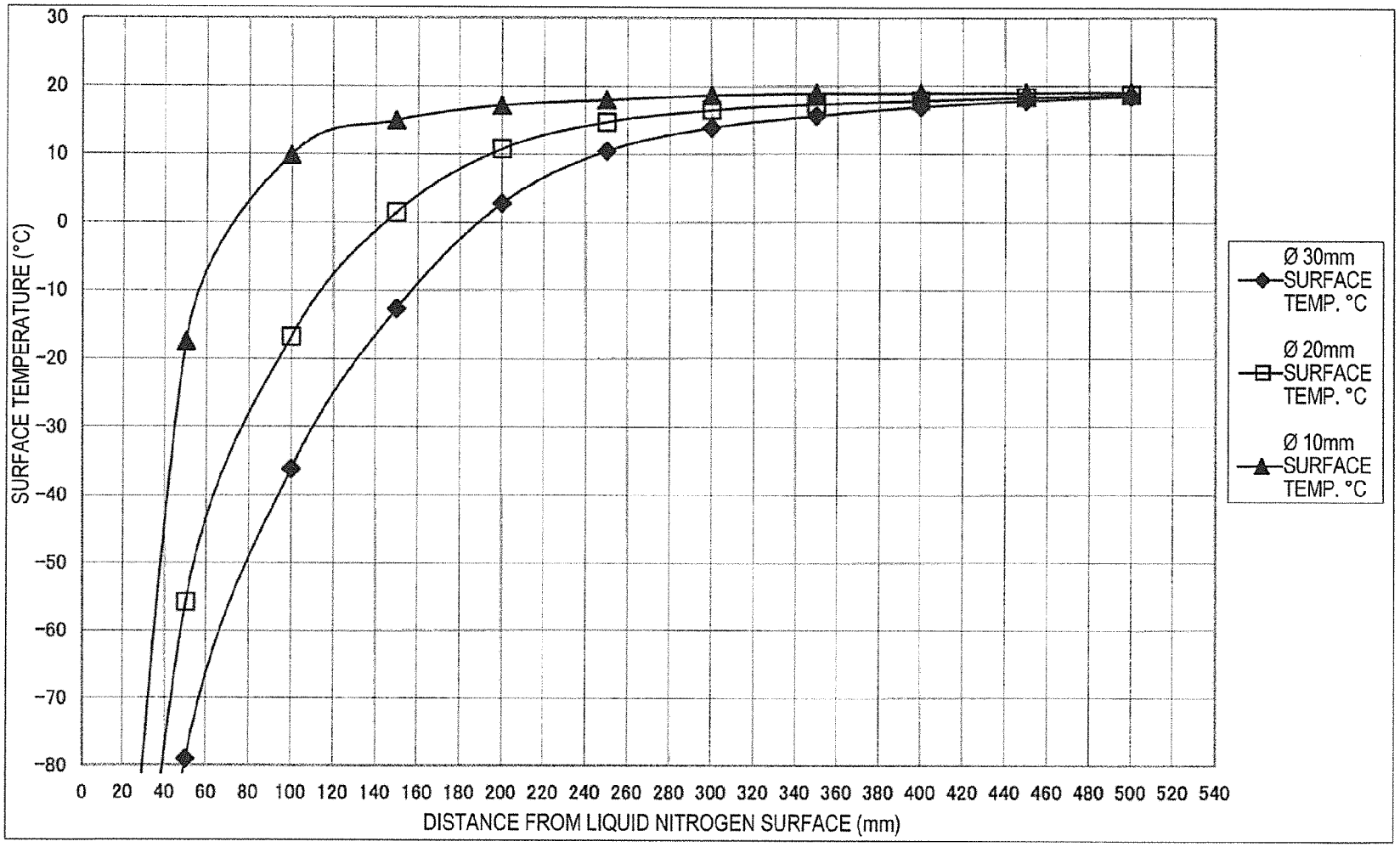
FIG. 8 is a graphic chart showing temperature distributions in a temperature stable state according to shaft diameters.

FIG. 8 is a graphic chart showing the temperature distribution in the temperature stable state according to the shaft diameters.

In accordance with the experiment result and with consideration of some tolerance, a temperature stabilizing time for all of the shaft diameters is estimated as 170 minutes after starting the experiment, and the graphic chart is prepared with regard to the temperature distribution in the temperature stable state.

Table 1 summarizes the relation between the stabled temperature and the distance from the surface of liquid nitrogen according to the respective shaft diameters, analyzed from the graphic chart.

TABLE 1

| Stabled | Distance from Surface of Liquid Nitrogen (mm) | | |
|---|---|---|---|
| Temperature (° C.) | Shaft Diameter 10 mm | Shaft Diameter 20 mm | Shaft Diameter 30 mm |
| −30 | 45 | 77 | 110 |
| −20 | 50 | 93 | 131 |
| −10 | 55 | 112 | 158 |
| 0 | 73 | 145 | 190 |
| 10 | 100 | 195 | 246 |

Next, the temperature distribution of the shaft and the temperature adjusting housing 12 is also discussed by theoretical calculation.

First, the temperature distribution of the pump shaft is calculated.

(1) A surface heat transfer rate by the natural convection is calculated (refer to the calculation formula of vertical plane and tube, JIS A 9501 2001 5.3.3 (2))

<Formula>

$$hcv=2.56\times\Delta\theta\hat{}0.25\times\{(\omega+0.3438)/0.348\}\hat{}0.5$$

hcv: surface heat transfer rate by convection ($W/(m^2\cdot K)$)

$\Delta\theta$: temperature difference (K) (calculated with the liquid nitrogen temperature as 77K, the room temperature as 293K)

$\omega$: wind velocity (m/s) (calculated as 0 m/s under natural convection)

<Calculation>

$$hcv = 2.56\times(293-77\hat{}0.25\times\{(0+0.3438)/0.348\}\hat{}0.5$$

$$= 9.814\ (W/m^2\cdot K))$$

2) Simplified Temperature Distribution Calculation

The simplified temperature distribution is calculated by utilizing the result of (1) ("Fundamental Study of Heat Transfer" by Suguru YOSHIDA, Rikogakusha Publishing Co., Ltd., p. 36-39 (1999)).

<Presumption>

The temperature on a cross-sectional surface perpendicular to the shaft is uniform.

A heat transfer rate $\alpha$ from the surface to the circumferential fluid (temperature: Tb) (hcv of the above calculated value) is uniform for the whole surface.

A cross-sectional area A and a circumferential length S are constant in the axial direction.

A heat conductivity $\lambda$ is constant.

<Calculation Conditions>

Overall Length H=0.5 m

Liquid Nitrogen Temperature T0=77K

Room Temperature Tb=293K

Heat Transfer rate $\alpha$=9.814 (the calculated value of (1))

Shaft Diameter $\phi$=30 mm (material: SUS304)

Shaft Circumferential Length S=0.0942 m

Shaft Cross-sectional Area $A=7.065\times10^{-4}$

SUS304 Heat Conductivity (room temperature: 293K) $\lambda$=15.9 W/(m·K)

("New Edition of Thermophysical Properties Handbook" edited by Japan Society of Thermophysical Properties, Yokendo Co., Ltd., p. 213 (2008))

<Calculation>

(x refers to the distance from the liquid surface to the temperature measurement point (m), and T refers to the temperature at the distance point).

$$m=((\alpha\times S)/(\lambda\times A))\hat{}0.5\ m^{-1} \quad \text{(based on Formula 2.73)}$$

Temperature Distribution $$\underline{\theta}=(e\hat{}(m(H-x))+e\hat{}(-m(H-x))/e\hat{}(mH)+e\hat{}(-mH)) \quad \text{(based on Formula 2.79)}$$

$$\underline{\theta}=(T-Tb)/(T0-Tb) \quad \text{(based on Formula 2.72)}$$

The above formulas are solved and the simplified temperature distribution is obtained.

<Calculation Result>

TABLE 2

| x(m) | Θ | T(K) |
|---|---|---|
| 0.00 | 1.0000 | 77 |
| 0.05 | 0.6355 | 156 |
| 0.10 | 0.4039 | 206 |
| 0.15 | 0.2569 | 238 |
| 0.20 | 0.1636 | 258 |
| 0.25 | 0.1046 | 270 |
| 0.30 | 0.0675 | 278 |
| 0.35 | 0.0445 | 283 |
| 0.40 | 0.0309 | 286 |
| 0.45 | 0.0237 | 288 |
| 0.50 | 0.0214 | 288 |

(3) Temperature Amendment According to the Simplified Temperature Distribution.

(A) A surface heat transfer rate by radiation at each of the calculation points is obtained, according to the temperature obtained by the simplified temperature distribution of (2). Then the calculation value of (1) is combined thereto to obtain a surface heat transfer rate (refer to JIS A 9501 2001 5.3.3 (1)).

$$hr=ar\times Cr(W/m^2K))$$

$$ar=((Tse)^4-(Ta)^4/(Tse-Ta)(K^3)$$

$$Cr=\epsilon\cdot\sigma(W/m^2\cdot K^4))$$

hr: surface heat transfer rate by radiation ($W/(m^2K)$)

Tse: temperature (K) at each of the distances obtained by the calculation of (2)

Ta: room temperature (293K)

$\epsilon$: 0.30 (using the value of stainless steel panel)

$\sigma$: Stefan-Boltzmann constant 5.67×10^−8(W/m^2·K^4)

Surface Heat Transfer Rate (hse) (refer to JIS A 9501 2001 5.3.3)

$$hse=hr+hcv$$

<Calculation Result>

TABLE 3

| x(m) | hr(W/(m$^2$ · K) | hse(W/(m$^2$ · K) |
|---|---|---|
| 0.00 | 0.578 | 10.392 |
| 0.05 | 0.840 | 10.654 |
| 0.10 | 1.088 | 10.902 |
| 0.15 | 1.284 | 11.098 |
| 0.20 | 1.426 | 11.240 |
| 0.25 | 1.523 | 11.337 |
| 0.30 | 1.588 | 11.402 |
| 0.35 | 1.629 | 11.443 |
| 0.40 | 1.654 | 11.468 |
| 0.45 | 1.667 | 11.481 |
| 0.50 | 1.671 | 11.485 |

(B) The heat conductivity at each of the calculation points is obtained, according to the temperature obtained by the simplified temperature distribution of (2).

For the purpose of obtaining the heat conductivities of SUS at the respective temperatures, the heat conductivities at 60K and 100K are read from the heat conductivity graphic chart of various materials at T>1K, in accordance with "Low-Temperature Engineering Handbook" supervised by Toyoichiro SHIGI, Uchida Rokakuho Publishing Co., Ltd., p. 197 (1982). Then an approximate linear functional equation between 60K-100K, and an approximate linear functional equation between 100K-293K are derived according to the heat conductivity used in the calculation of (2), to serve as the heat conductivity at each of the calculation points.

<Calculation Result>(the heat conductivity at the Temperature T of each point x is λ2).

TABLE 4

| x(m) | T(K) | λ 2(W/(m · K) |
|---|---|---|
| 0.00 | 77 | 8.3 |
| 0.05 | 156 | 11.7 |
| 0.10 | 206 | 13.2 |
| 0.15 | 238 | 14.2 |
| 0.20 | 258 | 14.8 |
| 0.25 | 270 | 15.2 |
| 0.30 | 278 | 15.5 |
| 0.35 | 283 | 15.6 |
| 0.40 | 286 | 15.7 |
| 0.45 | 288 | 15.7 |
| 0.50 | 288 | 15.8 |

Provided that the calculated value of (A) above is α, and the calculated value of (B) is λ, the calculation of (2) is conducted again in order to obtain the temperature distribution value by calculation.

<Calculation Conditions>

Overall Length H=0.5 m

Liquid Nitrogen Temperature T0=77K

Room Temperature Tb=293K

Surface Heat Transfer rate α=value of hse obtained by (A)

Shaft Diameter ϕ=30 mm (material: SUS304)

Shaft Circumferential Length S=0.0942 m

Shaft Cross-sectional Area A=7.065×10$^{-4}$

SUS304 Heat Conductivity λ=The value of λ2 obtained by the calculation of (B), W/(m·K)

<Calculation>

(x refers to the distance from the liquid surface to the temperature measurement point (m), and T2 refers to the temperature at the distance point).

$m=((\alpha\times S)/(\lambda\times A))\hat{}0.5\ m^{-1}$ (based on Formula 2.73)

Temperature Distribution $\underline{\theta}2=(e\hat{}(m(H-x)+e\hat{}(-m(H-x)/(e\hat{}(mH)+e\hat{}(-mH)$ (based on Formula 2.79)

$\underline{\theta}2=(T-Tb)/(T0-Tb)$ (based on Formula 2.72)

The above formulas are solved and the temperature distribution is obtained.

<Calculation Result>

TABLE 5

| x(m) | Θ 2 | T2(K) |
|---|---|---|
| 0.00 | 1.0000 | 77 |
| 0.05 | 0.5765 | 168 |
| 0.10 | 0.3507 | 217 |
| 0.15 | 0.2165 | 246 |
| 0.20 | 0.1341 | 264 |
| 0.25 | 0.0833 | 275 |
| 0.30 | 0.0520 | 282 |
| 0.35 | 0.0330 | 286 |
| 0.40 | 0.0220 | 288 |
| 0.45 | 0.0162 | 289 |
| 0.50 | 0.0145 | 290 |

Figure 9:
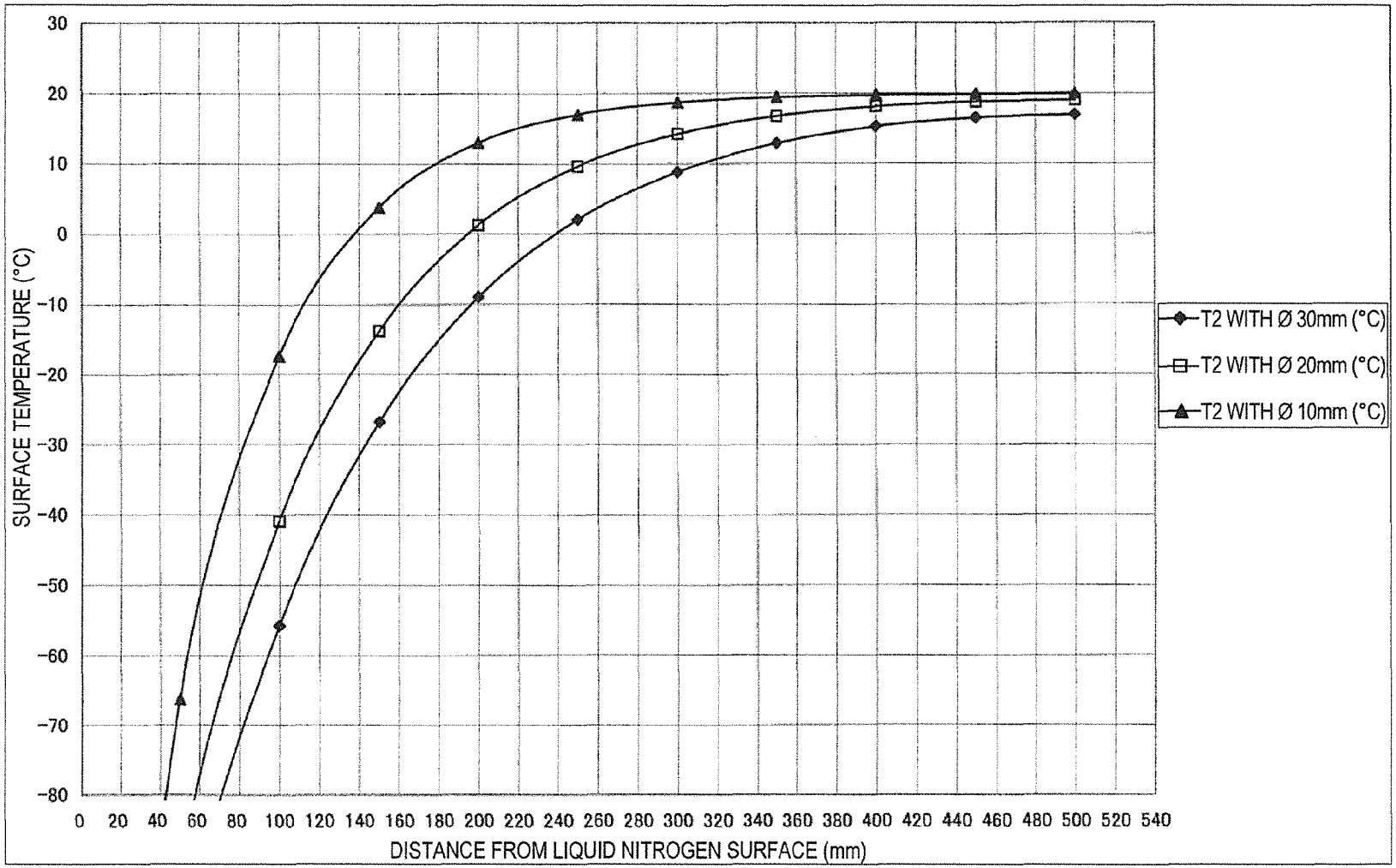
FIG. 9 is a graphic chart showing heat transfer temperature distributions according to the difference of shaft diameters (theoretical calculation value).

(4) In the case that the pump shaft diameter ϕ is 10 mm or 20 mm, when the calculations of (1) to (3) are also conducted, the result as shown in FIG. 9 is obtained. Table 6 shows typical read values of temperature and the distance from the surface of liquid nitrogen.

<Calculation Result>

TABLE 6

| Stabled | Distance from Surface of Liquid Nitrogen (mm) | | |
|---|---|---|---|
| Temperature (° C.) | Shaft Diameter 10 mm | Shaft Diameter 20 mm | Shaft Diameter 30 mm |
| −30 | 85 | 115 | 145 |
| −20 | 95 | 135 | 170 |
| −10 | 110 | 160 | 195 |
| 0 | 135 | 195 | 240 |
| 10 | 180 | 250 | 310 |

(Temperature Distribution Calculation of the Heat Adjusting Housing)

Figure 10:
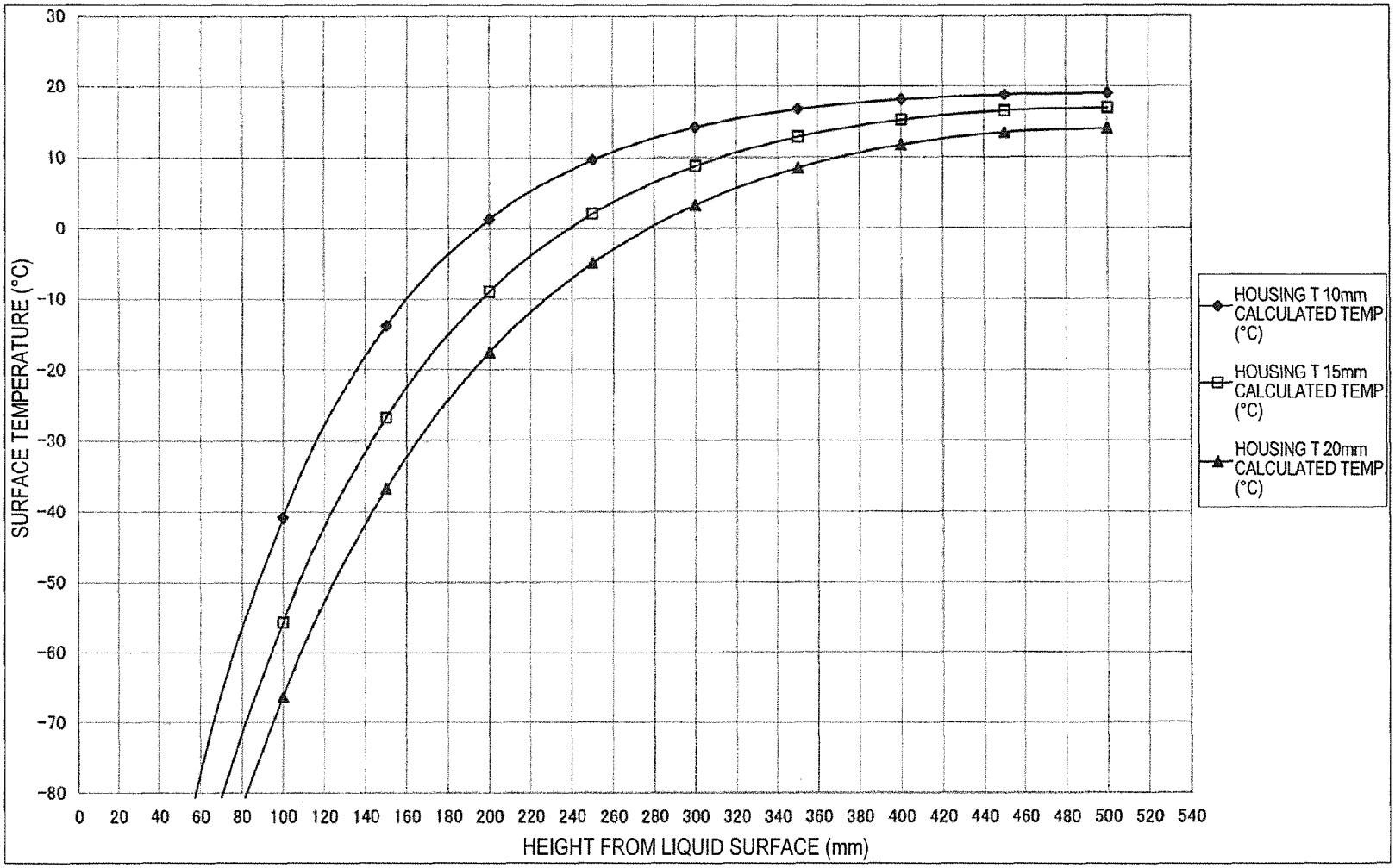
FIG. 10 is a graphic chart showing heat transfer temperature distributions according to the difference in thickness of a heat adjusting housing (theoretical calculation value).

In a similar concept to that of the pump shaft, when the temperature distribution according to the difference in thickness of the heat adjusting housing (material: SUS304) is obtained, the result comes out as FIG. 10 (calculated according to the calculations (1) to (4) as described above). Note that the calculation is conducted with the inner diameter of the heat adjusting housing as 100 mm.

As it is clear from the results of these experiments and theoretical calculations, both the actual measured value and the theoretical value show the similar result aspects. It is clear that the present invention has the sufficient industrial applicability when the shaft and the heat adjusting housing are designed in accordance with these results.

DESCRIPTION OF REFERENCE NUMERALS

1: Motor
2: Impeller
3: Shaft

4*a*: Pressure-resistance wall
4*b*: Pressure-resistance wall
5: Motor space
6: Introduction Channel
7: Volute Housing
8: Discharge Part
9: Impeller Space
10: Inducer
11: Heat Adjusting unit
12: Heat Adjusting Housing
13: Shaft Space
14: Enclosed Space
15: Fin
16: Bearing
17: Cooling fan
18: Fan Cover
19: Pump unit
20: Motor unit
21*a*: Outer Wall
21*b*: Outer Wall
22*a*: Pressure Wall
22*b*: Pressure Wall
24: Fan
25: Inner Magnet
26: Pressure-resistance Cover
27: Outer Magnet

What is claimed is:

1. A cryogenic pump for liquefied gas for applying a pressure difference to the liquefied gas so as to pump-transfer the gas, the cryogenic pump comprising:

a motor; and an impeller driven by the motor to cause pump-transfer of the liquefied gas, wherein the motor and the impeller are coupled to each other by a rotation transmitting structure configured for transmitting a rotative drive force therebetween, wherein the motor and the impeller are arranged so that the motor is positioned on an upper side and the impeller is positioned on a lower side, wherein the motor and the impeller exist in an enclosed space into which the liquefied gas is introduced, wherein the enclosed space comprises a space for the motor, a space for the impeller and a space for at least a part of the rotation transmitting structure, wherein the space for the motor is positioned above the space for the impeller, wherein the cryogenic pump further comprises a heat adjusting unit between the motor and the impeller and residing in an atmosphere, wherein the heat adjusting unit comprises a heat adjusting housing that forms the space for the at least part of the rotation transmitting structure, the rotation transmitting structure and heat adjusting unit configured to maintain a temperature in the impeller space in a range in which the liquefied gas is in its liquid phase and to maintain a temperature in the motor space in which the liquefied gas therein is in its gaseous phase, wherein the heat adjusting unit comprises a plurality of fins configured to cause heat to conduct between the atmosphere and rotation transmitting structure through the heat adjusting housing.

2. The cryogenic pump for liquefied gases of claim 1, wherein the rotation transmitting structure comprises at least one shaft provided coaxially to both a rotational axis of the motor and a rotational axis of the impeller.

3. The cryogenic pump for liquefied gases of claim 2, wherein the at least one shaft is supported by a bearing in the motor space within the enclosed space.

* * * * *